US010560788B2

(12) United States Patent
Oddershede et al.

(10) Patent No.: US 10,560,788 B2
(45) Date of Patent: Feb. 11, 2020

(54) HEARING DEVICE WITH SOUND IMPULSE SUPPRESSION AND RELATED METHOD

(71) Applicant: GN HEARING A/S, Ballerup (DK)

(72) Inventors: Niels Oddershede, Ballerup (DK); Ditlev Munk Rabøl, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 15/819,118

(22) Filed: Nov. 21, 2017

(65) Prior Publication Data

US 2018/0184216 A1 Jun. 28, 2018

(30) Foreign Application Priority Data

Dec. 23, 2016 (EP) ..... 16206674

(51) Int. Cl.
*H04R 3/00* (2006.01)
*H04R 25/00* (2006.01)

(52) U.S. Cl.
CPC ..... *H04R 25/453* (2013.01)

(58) Field of Classification Search
CPC .... H04R 3/002; H04R 3/005; H04R 2499/11; H04R 5/033; H04R 2410/07; H04R 25/407; G10L 21/0232; G10L 21/0264; G10L 15/14; G10L 15/083; G10L 15/32
See application file for complete search history.

(56) References Cited

U.S. PATENT DOCUMENTS 6,430,450 B1 * 8/2002 Bach-y-Rita ..... A61F 9/08 379/52
8,675,890 B2 * 3/2014 Schmidt ..... G10L 21/0272 381/92
8,781,137 B1 * 7/2014 Goodwin ..... H04R 3/005 381/94.1
2009/0099476 A1 * 4/2009 Fogel ..... A61B 5/121 600/559

FOREIGN PATENT DOCUMENTS

EP 1450354 * 2/2004 ..... G10L 21/02

* cited by examiner

*Primary Examiner* — Amir H Etesam
(74) *Attorney, Agent, or Firm* — Vista IP Law Group, LLP

(57) ABSTRACT

Disclosed is a method and a hearing device. The hearing device comprises a first microphone for provision of a first microphone input signal; a sound impulse suppression module configured for detecting a sound impulse in the first microphone input signal; a processor for processing the first microphone input signal in a processing set of frequency bands to obtain an electrical output signal; and a receiver for converting the electrical output signal to an audio output signal, wherein the sound impulse suppression module is configured to apply a detection scheme on the first microphone input signal, wherein the detection scheme defines a detection set of frequency bands, wherein the frequency bands of the detection set covers a part of the frequency bands of the processing set, and wherein a sound impulse is detected based on the detection set of frequency bands.

27 Claims, 3 Drawing Sheets

HEARING DEVICE WITH SOUND IMPULSE SUPPRESSION AND RELATED METHOD

RELATED APPLICATION DATA

This application claims priority to, and the benefit of, European Patent Application 16206674.0 filed Dec. 23, 2016, pending. The entire disclosure of the above application is expressly incorporated by reference herein.

FIELD

The present disclosure relates to a hearing device with sound impulse suppression and related method.

BACKGROUND

Sound impulses with high sound pressure levels may be discomforting, painful or even damaging to users of a hearing device. In particular, hearing aid compressors utilize dynamic sound level compression with time constants that are sufficiently long to reduce distortion of temporal characteristics of speech, which however reduces the ability to compress sound impulses with high energy, in turn increasing the discomfort for a hearing aid user.

SUMMARY

There is a need for devices and methods overcoming or at least reducing the discomfort resulting from sound impulses.

Accordingly, a hearing device is disclosed, the hearing device comprising a first microphone for provision of a first microphone input signal; a sound impulse suppression module configured for detecting a sound impulse in the first microphone input signal; a processor for processing the first microphone input signal in a processing set of frequency bands to obtain an electrical output signal; and a receiver for converting the electrical output signal to an audio output signal. The sound impulse suppression module is configured to apply a detection scheme on the first microphone input signal, wherein the detection scheme optionally defines a detection set of frequency bands, wherein the frequency bands of the detection set optionally covers a part of the frequency bands of processing set, and wherein a sound impulse is detected based on the detection set of frequency bands.

Further, a method of operating a hearing device is provided, the hearing device comprising a processor configured to process a first microphone input signal from a first microphone in a processing set of frequency bands to obtain an electrical output signal, wherein the method comprises detecting a sound impulse in the microphone input signal; and reducing a gain applied to the first microphone input signal (or to a signal based on the first microphone input signal, such as a beamformed signal based on the first microphone input signal) in the processor when a sound impulse is detected, wherein detecting a sound impulse comprises applying a detection scheme on the first microphone input signal, wherein the detection scheme defines a detection set of frequency bands, wherein the detection set of frequency bands optionally covers a part of the frequency bands of processing set, and wherein detecting a sound impulse is based on the detection set of frequency bands.

The present hearing devices and methods provide improved impulse suppression in a hearing device. For example, the present hearing devices can be tailored to suppress specific types of sound impulses. Further, the present disclosure provides a power and processing efficient impulse suppression, which is important considering the limited power and processing resources available in a hearing device.

A hearing device includes: a first microphone configured to provide of a first microphone input signal; a sound impulse suppression module configured to detect a sound impulse in the first microphone input signal; a processor configured to process the first microphone input signal in a first set of frequency bands to obtain an electrical output signal; and a receiver configured to provide an audio output signal based on the electrical output signal; wherein the sound impulse suppression module is configured to detect the sound impulse based on a second set of frequency bands, and wherein the frequency bands of the second set covers a part of the frequency bands of the first set.

Optionally, the frequency bands of the second set have lower frequencies above a first frequency threshold.

Optionally, the frequency bands of the second set have upper frequencies below a second frequency threshold.

Optionally, the frequency bands of the second set are within one or more frequency ranges.

Optionally, the first set of frequency bands comprises L frequency bands and the second set of frequency bands comprises M frequency bands, and wherein L-M is greater than or equal to 3.

Optionally, the sound impulse suppression module is configured to determine rise parameters of the first microphone input signal in the frequency bands of the second set, wherein at least one of the rise parameters is indicative of a power increase in the first microphone input signal, and wherein the sound impulse suppression module is configured to detect the sound impulse based on the rise parameters.

Optionally, the sound impulse suppression module is configured to detect the sound impulse based on a number of at least some of the rise parameters reaching respective rise thresholds.

Optionally, the sound impulse is considered to have been detected by the sound impulse suppression module if the number of the at least some of the rise parameters that have reached the respective rise thresholds is larger than a number threshold.

Optionally, the sound impulse suppression module is configured to use a detection scheme to detect the sound impulse, and wherein the detection scheme involves rise thresholds for at least some of the frequency bands of the second set.

Optionally, one of the rise thresholds for one of the at least some of the frequency bands in the second set is different from another one of the rise thresholds for another one of the at least some of the frequency bands in the second set.

Optionally, the rise parameters are based on an instant power estimate and a reference power estimate of the first microphone input signal.

Optionally, the hearing device further includes a broadband power estimator, and wherein the sound impulse suppression module is configured to detect the sound impulse based on a broadband power estimate from the broadband power estimator.

Optionally, the sound impulse suppression module is configured to reduce a gain applied to the first microphone input signal by the processor after the sound impulse is detected.

Optionally, the hearing device further includes a sound environment detector for classifying a sound environment; wherein the sound impulse suppression module is configured to apply a first detection scheme if the sound environment is classified as a first sound environment, and wherein the sound impulse suppression module is configured to apply a second detection scheme different from the first detection scheme if the sound environment is classified as a second sound environment.

A method performed by a hearing device comprising a processor configured to process a first microphone input signal from a first microphone in a first set of frequency bands to obtain an electrical output signal, the method includes: detecting a sound impulse in the microphone input signal; and reducing a gain applied to the first microphone input signal in the processor after the sound impulse is detected; wherein the sound impulse is detected based on a second set of frequency bands, and wherein the frequency bands of the second set covers a part of the frequency bands of the first set.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
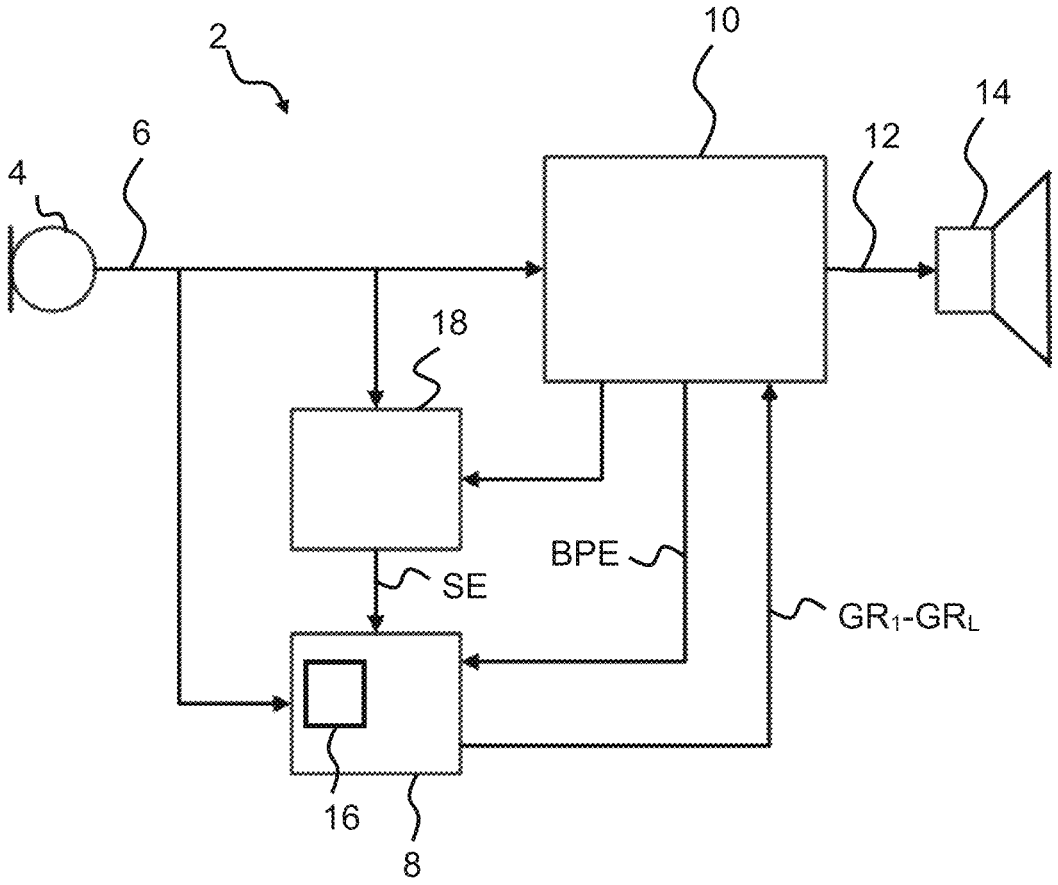
FIG. 1 schematically illustrates an exemplary hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. The hearing aid may be a binaural hearing aid.

The hearing device may be a hearing aid and the processor may be configured to compensate for hearing loss of a user.

The hearing device may be a headset, a headphone, an earphone, an ear defender, or an earmuff, such as an Ear-Hook, In-Ear, On-Ear, Over-the-Ear, Behind-the-Neck, Helmet, or Headguard.

The hearing device comprises a first microphone for provision of a first microphone input signal. The hearing device may comprise a second microphone for provision of a second microphone input signal. The hearing device may comprise J microphones for provision of J microphone signals, wherein J is an integer in the range from 1 to 10. In one or more exemplary hearing devices, the number J of microphones is two, three, four, five or more. The hearing device may comprise a third microphone for provision of a third microphone input signal.

The hearing device comprises a sound impulse suppression module. The sound impulse suppression module is configured for detecting a sound impulse in the first microphone input signal. The sound impulse suppression module may be configured for operation in the frequency domain. The sound impulse suppression module may comprise an impulse detector optionally configured for operation in the frequency domain, e.g. utilizing a Fourier Transformation, such as the Discrete Fourier Transformation, the Fast Fourier Transformation, etc., for transforming the first microphone input signal into a frequency domain for detecting the sound impulse.

The impulse detector may be configured for utilizing a warped frequency transformation, such as the Warped Fourier Transformation, the Warped Discrete Fourier Transformation, the Warped Fast Fourier Transformation, etc., for transforming the first microphone input signal into a warped frequency domain.

The warped frequency bands may correspond to the Bark frequency scale of the human ear.

The sound impulse suppression module may be configured for detecting a sound impulse in a second microphone input signal.

The hearing device comprises a processor for processing the first microphone input signal in a processing set, PFB, of frequency bands $FP_i$, where i is an index from 1 to L, to obtain an electrical output signal. The processor may be configured to compensate for hearing loss of a user.

The processor may comprise a filter bank for filtering the first microphone input signal into the frequency bands $FP_1$, $FP_2$, . . . , $FP_L$, where the number L of frequency bands in the processing set PFB may be at least 10, such as 15, 17 or 24. In one or more exemplary hearing devices, the number L of frequency bands in the processing set PFB may be 20 or more, such as 64. In one or more exemplary hearing devices, the number L of frequency bands in the processing set PFB may be from 5 to 10.

Further, the hearing device comprises a receiver for converting the electrical output signal to an audio output signal.

The sound impulse suppression module is configured to apply a detection scheme, such as a first detection scheme and/or a second detection scheme, on the first microphone input signal.

A detection scheme defines a detection set DFB of frequency bands $FD_j$, where j is an index from 1 to M, and a sound impulse is detected based on the detection set of frequency bands.

The frequency bands of the detection set may cover a part of the frequency bands of processing set. Thus, the frequency bands of the processing set cover frequencies that are not covered by the frequency bands of the detection set, and the sound impulse suppression module therefore operates on a reduced frequency range. Therefore, the required processing for impulse detection is reduced compared to a full-fetched sound impulse suppression based on the processing set of frequency bands.

In one or more exemplary hearing devices, the frequency bands of the detection set may be selected as a proper subset of the frequency bins of a DFT or FFT. In one or more exemplary hearing devices, the number M of frequency bands of the detection set may be less than K, where K is the number of available frequency bins of an FFT employed in the impulse detector/sound impulse suppression module.

The frequency bands $FD_j$, j=1, . . . , M of the detection set each have center frequencies denoted $fd_{0,j}$, and bandwidths denoted $BD_j$. The frequency bands $FP_i$, i=1, . . . , L of the detection set each have center frequencies denoted $fp_{0,i}$ and bandwidths denoted $BP_i$. In one or more hearing devices, the minimum center frequency of center frequencies $fd_{0,j}$, j=1, . . . , M is larger than a first center frequency threshold FCTH. The first center frequency threshold FCTH may be larger than 500 Hz, such as larger than 1 kHz, e.g. about 2 kHz.

In one or more hearing devices, the maximum center frequency of center frequencies $fd_{0,j}$, j=1, . . . , M is larger than a second center frequency threshold SCTH. The second center frequency threshold SCTH may be less than 6 kHz, such as less than 1 kHz, e.g. about 2 kHz. The average center frequency of $fd_{0,j}$, j=1, . . . , M may be larger than 0.55*BP, such as larger than 0.6*BP, where BP is the bandwidth of the processor, typically about 8-12 kHz. The average center frequency of $fd_{0,j}$, j=1, . . . , M may be less than 0.45*BP, such as less than 0.4*BP, where BP is the bandwidth of the processor, typically about 8-12 kHz. A high average center frequency is indicative of impulse detection in high-frequency bands and a low average center frequency is indicative of impulse detection in low-frequency bands.

The detection set of frequency bands may be a proper subset of the processing set of frequency bands.

A frequency band has a lower frequency $f_l$ and an upper frequency $f_u$. The frequency bands $FD_1$-$FD_M$ of the detection subset has lower frequencies denoted $f_{l,j}$ and upper frequencies denoted $f_{u,j}$, where j=1, . . . , M.

The frequency bands of the detection set may have lower frequencies $f_{l,1}$, . . . , $f_{l,M}$ above a first frequency threshold. In one or more exemplary hearing devices, the first frequency threshold FFTH may be larger than 1 kHz, such as in the range from 1.5 kHz to 5 kHz, e.g. 3 kHz.

The frequency bands of the detection set may have upper frequencies $f_{u,1}$, . . . , $f_{u,M}$ below a second frequency threshold. In one or more exemplary hearing devices, the second frequency threshold SFTH may be less than 6 kHz, such as in the range from 1 kHz to 5 kHz, e.g. 3 kHz.

The frequency bands of the detection set may be arranged within one or more frequency ranges including a first frequency range. The frequency bands of the detection set may be arranged within a first frequency range and a second frequency range, wherein the first frequency range and the second frequency range are separate frequency ranges. In one or more exemplary hearing devices, one or more frequency bands of the detection set are arranged within a first frequency range, e.g. from 100 Hz to 1 kHz and one or more frequency bands of the detection set are arranged within a second frequency range, e.g. from 3 kHz to 8 kHz.

In one or more exemplary hearing devices, the frequency bands of the detection set may be selected as a number of the frequency bins of a DFT or FFT. In one or more exemplary hearing devices, the number M of frequency bands of the detection set is less than K, where K is the number of available frequency bins of an FFT employed in the impulse detector/sound impulse suppression module. For an exemplary detection set, M−K>3.

The detection set DFB of frequency bands applied by the sound impulse suppression module may have less frequency bands than the processing set PFB of frequency bands. Thus, the number of frequency bands in the detection set may be lower than the number of frequency bands in the processing set of frequency bands. Reducing the number of frequency bands in the detection set provides a power efficient and yet reliable detection scheme, e.g. compared to monitoring all frequency bands of the processing set. In one or more exemplary hearing devices, PFB={$FP_1$, $FP_2$, . . . , $FP_L$} and {$FD_1$, $FD_2$, . . . , $FD_M$}, where L is larger than 10, such as 15 or 17. Further, tailoring the frequency bands of the detection set DFB enables the hearing aid designer to ignore sound impulses in one or more frequency bands, e.g. in order to allow/not react on (suppress) sound impulses in one or more frequency bands, where the user actually would like to hear the sound impulses.

In one or more exemplary hearing devices, the processing set of frequency bands comprises L frequency bands and the detection set of frequency bands comprises M frequency bands, wherein L is larger than M. In one or more exemplary hearing devices, L−M is greater than or equal to 3. M may be 1, 2, 3, 4 or more. In one or more exemplary hearing devices, M is in the range from 5 to 20. In one or more exemplary hearing devices, L−M is greater than or equal to 1 or 2.

The number M of frequency bands in the detection set may be less than fourteen, such as less than twelve or less than ten. The number L of frequency bands in the processing set may be larger than four, e.g. larger than ten, such as larger than twelve or larger than fourteen.

The sound impulse suppression module may be configured to determine rise parameter(s) $R_j$ of the first microphone input signal in the frequency band(s) of the detection set. The sound impulse suppression module may be configured to detect a sound impulse based on the rise parameters.

A rise parameter $R_j$ is indicative of a power increase in the first microphone input signal in a frequency band $FD_j$.

For example, where DFB={$FD_1$, $FD_2$, . . . , $FD_{12}$}, the sound impulse suppression module determines twelve rise parameters $R_1$-$R_{12}$ and detects a sound impulse based on the rise parameters $R_1$-$R_{12}$.

The rise parameters $R_j$ may be based on an instant power estimate and a reference power estimate of the first microphone input signal in the respective frequency bands.

The rise parameter(s) $R_j$ may be given as:

$$R_j = \frac{P_j}{\mathrm{P_ref}_j},$$

where $P_j$ is an instant power estimate of frequency band $FD_j$ and $P_ref_j$ is a reference power estimate of the first microphone input signal in frequency band $FD_j$.

In one or more exemplary hearing devices, the rise parameter $R_j$ may advantageously be implemented in the logarithmic domain, such as the log 2 domain. The precision of the log 2 is found to be sufficiently accurate, and the remaining part of the impulse detector could improve by having decision and threshold implemented in the logarithmic domain. Thus, rise parameter(s) $R_j$ may be given as:

$$R_j = \log_2 P_j - \log_2 P_\mathrm{ref}_j,$$

where $P_j$ is an instant power estimate and $P_ref_j$ is a reference power estimate of the first microphone input signal in frequency band $FD_j$.

The sound impulse suppression module may be configured to detect a sound impulse based on the number of rise parameters that has reached a respective rise threshold.

A rise threshold may be a common rise threshold TH for all frequency bands i.e. the same rise threshold may be applied to each of the frequency bands $FD_j$.

In one or more exemplary hearing devices, a rise threshold $TH_j$ may be applied for each frequency band $FD_j$. Rise thresholds $TH_j$ may be different for different frequency bands. For example, a rise threshold $TH_7$ for $FD_7$ may be different for the rise threshold $TH_{10}$ for $FD_{10}$. The rise thresholds $TH_j$ may be defined in the $\log_2$ domain.

In one or more exemplary hearing devices, a rise threshold $TH_j$ may be applied for a plurality of groups of frequency band $FD_j$. For example, a first rise threshold $TH_x$ may be applied to a first group of frequency bands $FD_j$, such as for example $FD_1$-$FD_6$, and a second rise threshold $TH_y$ may be applied to a second group of frequency bands $FD_j$ such as for example $FD_7$-$FD_{12}$. In one or more exemplary hearing devices, a first rise threshold $TH_x$ may be applied to a first group of frequency bands $FD_j$, such as for example $FD_1$-$FD_3$ and $FD_8$ and $FD_{10}$-$FD_{12}$, and a second rise threshold $TH_y$ may be applied to a second group of frequency bands $FD_j$ such as for example $FD_4$-$FD_7$ and $FD_{11}$.

Thus, the sound impulse suppression module may be configured to determine if rise parameter $R_j$ have reached respective rise threshold $TH_j$ for the frequency bands in the detection set DFB, i.e. if $R_j \geq TH_j$ for $FD_j$. In one or more exemplary hearing devices, the rise threshold of one frequency band in the detection set is different from the rise threshold of another frequency band in the detection set, e.g. $TH_8 \neq TH_{10}$.

In one or more exemplary hearing devices, a sound impulse may be detected if the number of rise parameters that has reached a respective rise threshold is larger than a rise number threshold. For example where DFB={$FD_1$, $FD_2$, . . . , $FD_{12}$}, a sound impulse may be detected if more than RNTH=8 rise parameters out of $R_1$-$R_{12}$ have reached their respective rise threshold $TH_1$-$TH_{12}$, where RNTH is the rise number threshold.

The detection scheme may define rise thresholds for the frequency bands of the detection set. The detection scheme may define the rise number threshold.

The sound impulse suppression module may be configured to determine a rise parameter if the instant power estimate of a frequency band in the detection set of frequency bands is greater than the reference power estimate of the frequency band.

In one or more exemplary hearing devices, the rise parameter is determined if the instant power estimate is greater than the reference power estimate plus a power estimate threshold $PETH_j$.

The reference power estimate may be a smoothed power estimate based on the instant power estimate and a smoothing parameter. In one or more exemplary hearing devices, the reference power estimate may be base d on power estimates in a reference time period of at least 400 ms, such as at least 1 s.

The reference power estimate may be calculated as an average over a plurality of previous instant power estimates. The average may be an average over previous instant power estimates over time.

The instant power estimate $P_i$ may be based on a single input block of samples. The instant power estimate $P_i$ may be based on a number of input blocks of samples, e.g. wherein the number of input blocks is less than 5. An input block has a time length $T_{block}$ given as:

$$T_{block} = N \cdot \frac{1}{f_s},$$

where N is the size of a discrete Fourier Transform DFT or a fast Fourier Transform FFT and $f_s$ is the sampling frequency. In one or more exemplary hearing devices, $T_{block}$ is in the range from 1-2 ms, e.g. about 1.5 ms. Thus, the number of input block samples used for determining the instant power estimate is kept low to enable detection of sound impulses with very short rise times.

The hearing device may comprise a broadband power estimator, and the sound impulse suppression module may be configured to detect a sound impulse based on a broadband power estimate from the broadband power estimator, e.g. if the broadband power estimate is larger than a broadband power threshold, BPTH. The detection scheme may define the broadband power threshold, BPTH. The sound impulse suppression module may be configured to apply the detection scheme based on the broadband power estimate. For example, the sound impulse suppression module may be configured to apply a first detection scheme if the broadband power estimate is in a first range, e.g. indicative of low broadband power, and/or the sound impulse suppression module may be configured to apply a second detection scheme different from the first detection scheme if the broadband power estimate is in a second range, e.g. indicative of high broadband power.

The sound impulse suppression module may be configured to reduce a gain applied to the first microphone input signal (or to a signal based on the first microphone input signal, such as a beamformed signal based on the first microphone input signal) by the processor when a sound impulse is detected. For example, the sound impulse suppression module may be configured to reduce the gain in frequency bands where the rise parameter $R_j$ has reached the rise threshold $TH_j$ for the respective frequency bands. For example, the gain $G_{10}$ applied to the first microphone input signal in $FP_{10}$ may be reduced if $R_{10} \geq TH_{10}$.

The sound impulse suppression module may be configured to determine one or more gain reductions and transmit the one or more gain reductions to the processor. The sound impulse suppression module may be configured to determine one or more gain reductions based on the rise parameters $R_j$ and/or gain parameters of frequency bands $FP_1$-$FP_L$.

The gain reduction for one frequency band may be different from the gain reduction of another frequency band. For example, the gain reduction $GR_{10}$ for $FP_{10}$ may be different from the gain reduction $GR_{12}$ for $FP_{12}$. The sound impulse suppression module may be configured to determine a first gain reduction for a first subset of frequency bands, e.g. $FP_6$-$FP_9$, in PFB and a second gain reduction for a second subset, e.g. $FP_{10}$-$FP_{17}$, of frequency bands in PFB. The sound impulse suppression module may be configured to determine gain reductions $GR_1$-$GR_L$ for all or some of frequency bands $FP_1$-$FP_L$ in PFB.

The hearing device may comprise a sound environment detector for classifying the sound environment into a predetermined set of sound environments. The set of sound environments may comprise a first sound environment, a second sound environment and optionally a third sound environment. The sound impulse suppression module may be configured to apply the detection scheme based on the sound environment. For example, the sound impulse suppression module may be configured to apply a first detection scheme if the sound environment is classified as a first sound environment, and the sound impulse suppression module may be configured to apply a second detection scheme different from the first detection scheme if the sound environment is classified as a second sound environment.

Further, the present disclosure relates to a method of operating a hearing device comprising a processor configured to process a first microphone input signal from a first microphone in a processing set of frequency bands to obtain an electrical output signal, the hearing device comprising a sound impulse suppression module.

The method comprises detecting a sound impulse in the microphone input signal, e.g. with an impulse detector of the sound impulse suppression module.

The method comprises reducing a gain applied to the first microphone input signal in the processor, e.g. with a gain reduction module of the sound impulse suppression module, when a sound impulse is detected, In the method, detecting a sound impulse comprises applying a detection scheme on the first microphone input signal, e.g. in the impulse detector, wherein the detection scheme optionally defines a detection set of frequency bands, wherein the detection set of frequency bands optionally covers a part of the is a proper subset of the processing set of frequency bands, and wherein detecting a sound impulse is based on the detection set of frequency bands.

The method may comprise determining rise parameters of the first microphone input signal in the frequency bands of the detection set, wherein a rise parameter is indicative of a power increase in the first microphone input signal in a frequency band, and wherein detecting a sound impulse is based on the rise parameters.

In the method, detecting a sound impulse may be based on the number of rise parameters that has reached a respective rise threshold.

In the method, a sound impulse may be detected if the number of rise parameters that has reached a respective rise threshold is larger than a rise number threshold.

In the method, detecting a sound impulse may be based on a broadband power estimate from a broadband power estimator of the hearing device.

The method may comprise reducing a gain applied to the first microphone input signal (or to a signal based on the first microphone input signal, such as a beamformed signal based on the first microphone input signal) by the processor when a sound impulse is detected. The method may comprise determining one or more gain reductions and transmitting the one or more gain reductions to the processor. Determining one or more gain reductions may be based on the rise parameters $R_i$.

In one or more exemplary methods, the gain reduction $GR_i$ for one frequency band $FP_i$ is different from the gain reduction of another frequency band. For example, the gain reduction $GR_{10}$ for $FP_{10}$ may be different from the gain reduction $GR_{12}$ for $FP_{12}$. The method may comprise determining a first gain reduction for a first subset of frequency bands in PFB and a second gain reduction for a second subset of frequency bands in PFB.

In the method, the number of frequency bands in the detection set may be less than fourteen, and the number of frequency bands in the processing set may be larger than fourteen.

The method may comprise classifying the sound environment into a predetermined set of sound environments, and optionally applying a first detection scheme if the sound environment is classified as a first sound environment. The method may comprise applying a second detection scheme different from the first detection scheme if the sound environment is classified as a second sound environment.

Table 1 illustrates six exemplary detection schemes DS1-DS6 with associated parameters, where rise thresholds are given in the logarithmic domain. Further, exemplary processing frequency bands PFB associated with the processor are also given.

TABLE 1

Exemplary detection schemes DS1-DS6.

| | DS1 | DS2 | DS3 | DS4 | DS5 | DS6 |
|---|---|---|---|---|---|---|
| DFB | $FD_1$-$FD_{12}$ | $FD_1$-$FD_{14}$ | $FD_1$ | $FD_1$-$FD_{12}$ | $FD_1$-$FD_4$ | $FD_1$-$FD_5$ |
| PFB | $FP_1$-$FP_{17}$ | $FP_1$-$FP_{17}$ | $FD_1$-$FP_{17}$ | $FP_1$-$FP_{17}$ | $FP_1$-$FP_9$ | $FP_1$-$FP_{24}$ |
| RNTH | 8 | 5 | 1 | 10 | 3 | 2 |
| | $TH_j$ (j = 1-12) = 16 dB | $TH_j$ (j = 1-14) = 16 dB | $TH_1$ = 20 dB | $TH_j$ (j = 1-7) = 16 dB<br>$TH_j$ (j = 8-12) = 9 dB | $TH_1$ = 2 dB<br>$TH_2$ = 6 dB<br>$TH_j$ (j = 3-4) = 9 dB | $TH_1$ = 1 dB<br>$TH_2$ = 2 dB<br>$TH_3$ = 3 dB<br>$TH_4$ = 4 dB<br>$TH_5$ = 5 dB |
| | $fd_{o,j}$ (j = 1-12) > 2 kHz | $fd_{o,j}$ (j = 1-14) < 9 kHz | $fd_{o,j}$ > 5 kHz | $fd_{o,j}$ (j = 1-12) > 1 kHz | | $fd_{o,j}$ (j = 1-5) > 6 kHz |
| FFTH | 3 kHz | | 6 kHz | 3 kHz | 500 Hz | 6 kHz |
| SFTH | | 9 kHz | | | 4 kHz | |
| BPTH | 80 dB | 80 dB | 90 dB | 85 dB | 75 dB | 80 dB |

FIG. 1 shows an exemplary hearing device. The hearing device 2 comprises a first microphone 4 for provision of a first microphone input signal 6; a sound impulse suppression module 8 configured for detecting a sound impulse in the first microphone input signal 6; a processor 10 for processing the first microphone input signal in a processing set of frequency bands with 17 frequency bands to obtain an electrical output signal 12; and a receiver 14 for converting the electrical output signal 12 to an audio output signal. The sound impulse suppression module 8 is configured to apply a detection scheme on the first microphone input signal, e.g. with impulse detector 16, wherein the detection scheme defines a detection set of frequency bands, and wherein a sound impulse is detected in impulse detector 16 based on the detection set of frequency bands. The frequency bands of the detection set covers a part of the frequency bands of the processing set and the number M of frequency bands in the detection set is less than the number L of frequency bands in the processing set. Further, the hearing device comprises a sound environment detector 18 for classifying the sound environment into a predetermined set of sound environments. The resulting sound environment SE of the sound environment classification is transmitted to the sound impulse suppression module 8. The sound impulse suppression module is optionally configured to apply the detection scheme based on the sound environment. For example, the sound impulse suppression module 8 is configured to apply a first detection scheme, e.g. DS1, if the sound environment is classified as a first sound environment, and the sound impulse suppression module 8 is configured to apply a second detection scheme, e.g. DS2, different from the first detection scheme if the sound environment is classified as a second sound environment. The processor feeds broadband power estimate BPE to the sound impulse suppression module.

The sound impulse suppression module is configured to apply a detection scheme, e.g. DS1, on the first microphone input signal, wherein the detection scheme defines a detection set of frequency bands, wherein the frequency bands of the detection set covers a part of the frequency bands of the processing set, and wherein a sound impulse is detected based on the detection set of frequency bands. In the detection scheme DS1, the frequency bands $FD_1$-$FD_{12}$ are selected as the $6^{th}$ to the $17^{th}$ frequency bins of an FFT with a 32-sample window length and a sampling frequency of in the range from 20-22 kHz. Thus, the frequency bands of the detection set have lower frequencies above a first frequency threshold of 2 kHz. Other sampling frequencies may be applied in the sound impulse suppression module.

The sound impulse suppression module 8 is configured to determine rise parameters (log domain) of the first microphone input signal in the frequency bands of the detection set, wherein a rise parameter is indicative of a power increase in the first microphone input signal in a frequency band, and wherein the sound impulse suppression module is configured to detect a sound impulse based on the rise parameters. The sound impulse suppression module 8 detects a sound impulse if the number of rise parameters that has reached a respective rise threshold is larger than a rise number threshold of 8. The rise thresholds are optionally defined by the detection scheme, i.e. the rise thresholds may change with change of detection scheme. In detection scheme DS1, the rise thresholds for the respective frequency bands are 16 db. The sound impulse suppression module 8 is configured to reduce a gain applied to the first microphone input signal by the processor when a sound impulse is detected by determining and transmitting gain reduction vector with gain reductions $GR_i$, i=1, . . . , L to the processor 10. The second detection scheme may be DS2, where different rise thresholds $TH_j$ are applied in DS2.

Figure 2:
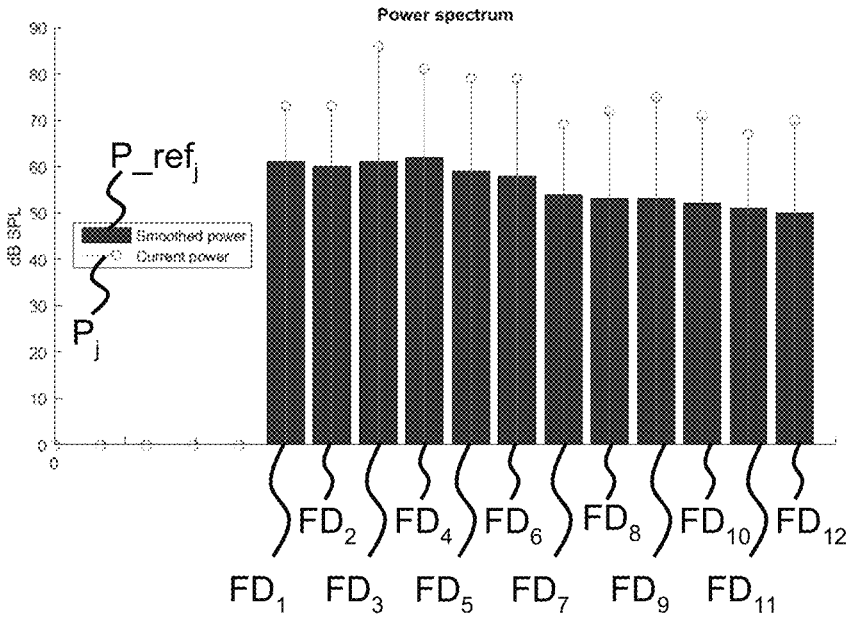
FIG. 2 is a power spectrum of frequency bands of a detection scheme.

FIG. 2 illustrates a power spectrum of frequency bands $FD_1$-$FD_{12}$ of detection scheme DS1, where $FD_1$ is the $6^{th}$ frequency bin of a 32-sample window FFT, $FD_2$ is the $7^{th}$ frequency bin, etc. Thus, the detection set is a proper subset of frequency bins 1-17 of the FFT applied in impulse detector 16. The instant power estimates $P_1$-$P_{12}$ of the frequency bands $FD_1$-$FD_{12}$ are all above the reference power estimates and $P_ref_1$-$Pref_{12}$. The broadband power estimate is 82 dB, which is larger than BPTH=80 dB of DS1. Further, more than RNTH=8 of the rise parameters $R_1$-$R_{12}$ have respectively reached $TH_1$-$TH_{12}$=16 dB. Therefore, a sound impulse is detected and a gain reduction vector with gain reductions $GR_1$-$GR_{17}$ is determined and fed to processor, such that the sound impulse is suppressed.

Figure 3:
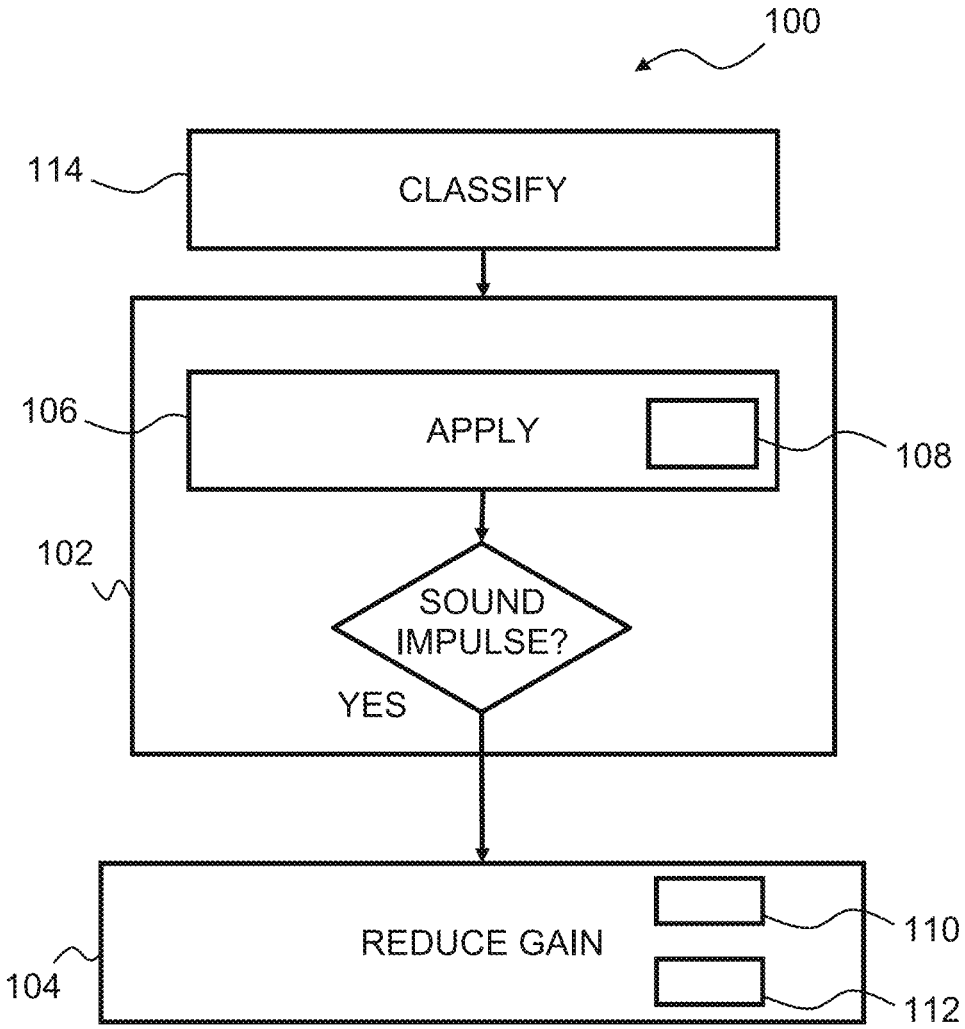
FIG. 3 is a flowchart of an exemplary method.

FIG. 3 is a flowchart of an exemplary method of operating a hearing device comprising a processor configured to process a first microphone input signal from a first microphone in a processing set of frequency bands to obtain an electrical output signal. The method 100 comprises detecting 102 a sound impulse in the microphone input signal; and reducing 104 a gain applied to the first microphone input signal in the processor when a sound impulse is detected. Detecting 102 a sound impulse comprises applying 106 a detection scheme on the first microphone input signal, wherein the detection scheme defines a detection set of frequency bands, wherein the detection set of frequency bands covers a part of the frequency bands of the processing set, and wherein detecting a sound impulse is based on the detection set of frequency bands. The method 100 comprises determining 108 rise parameters of the first microphone input signal in the frequency bands of the detection set, wherein a rise parameter is indicative of a power increase in the first microphone input signal in a frequency band. Detecting 102 a sound impulse is based on the rise parameters and the number of rise parameters that has reached a respective rise threshold, wherein a sound impulse is detected if the number of rise parameters that has reached a respective rise threshold is larger than a rise number threshold. Further, detecting 102 a sound impulse is based on a broadband power estimate from a broadband power estimator of the hearing device.

Reducing 104 a gain comprises determining 110 one or more gain reductions and transmitting 112 the one or more gain reductions to the processor. Determining one or more gain reductions are based on the rise parameters R and/or the broadband power estimate. The method 100 comprises classifying 114 the sound environment into a predetermined set of sound environments, and applying the detection scheme accordingly by applying a first detection scheme if the sound environment is classified as a first sound environment and applying a second detection scheme different from the first detection scheme if the sound environment is classified as a second sound environment.

Also disclosed are hearing devices and methods according to any of the following items.

Item 1. A hearing device comprising:

a first microphone for provision of a first microphone input signal;

a sound impulse suppression module configured for detecting a sound impulse in the first microphone input signal;

a processor for processing the first microphone input signal in a processing set of frequency bands to obtain an electrical output signal; and a receiver for converting the electrical output signal to an audio output signal, wherein the sound impulse suppression module is configured to apply a detection scheme on the first microphone input signal, wherein the detection scheme defines a detection set of frequency bands, wherein the frequency bands of the detection set covers a part of the frequency bands of the processing set, and wherein a sound impulse is detected based on the detection set of frequency bands.

Item 2. Hearing device according to item 1, wherein the frequency bands of the detection set have lower frequencies above a first frequency threshold.

Item 3. Hearing device according to any of items 1-2, wherein the frequency bands of the detection set have upper frequencies below a second frequency threshold.

Item 4. Hearing device according to any of items 1-3, wherein the frequency bands of the detection set are arranged within one or more frequency ranges including a first frequency range.

Item 5. Hearing device according to any of items 1-4, wherein the processing set of frequency bands comprises L frequency bands and the detection set of frequency bands comprises M frequency bands, and wherein L−M is greater than or equal to 3.

Item 6. Hearing device according to any of items 1-5, wherein the sound impulse suppression module is configured to determine rise parameters of the first microphone input signal in the frequency bands of the detection set, wherein a rise parameter is indicative of a power increase in the first microphone input signal in a frequency band, and wherein the sound impulse suppression module is configured to detect a sound impulse based on the rise parameters.

Item 7. Hearing device according to item 6, wherein the sound impulse suppression module is configured to detect a sound impulse based on the number of rise parameters that has reached a respective rise threshold.

Item 8. Hearing device according to item 7, wherein a sound impulse is detected if the number of rise parameters that has reached a respective rise threshold is larger than a rise number threshold.

Item 9. Hearing device according to any of items 7-8, wherein the detection scheme defines rise thresholds for the frequency bands of the detection set.

Item 10. Hearing device according to any of items 6-9, wherein the rise threshold of one frequency band in the detection set is different from the rise threshold of another frequency band in the detection set.

Item 11. Hearing device according to any of items 6-10, wherein the rise parameters are based on an instant power estimate and a reference power estimate of the first microphone input signal in the respective frequency bands.

Item 12. Hearing device according to item 11, wherein the reference power estimate is a smoothed power estimate based on the instant power estimate and a smoothing parameter.

Item 13. Hearing device according to any of items 1-12, wherein hearing device comprises a broadband power estimator, and wherein the sound impulse suppression module is configured to detect a sound impulse based on a broadband power estimate from the broadband power estimator.

Item 14. Hearing device according to any of items 1-13, wherein the sound impulse suppression module is configured to reduce a gain applied to the first microphone input signal by the processor when a sound impulse is detected.

Item 15. Hearing device according to any of items claims 1-14, wherein the number of frequency bands in the detection set is less than fourteen, and the number of frequency bands in the processing set is larger than fourteen.

Item 16. Hearing device according to any of items 1-15, wherein the hearing device comprises a sound environment detector for classifying the sound environment into a predetermined set of sound environments, wherein the sound impulse suppression module is configured to apply a first detection scheme if the sound environment is classified as a first sound environment, and wherein the sound impulse suppression module is configured to apply a second detection scheme different from the first detection scheme if the sound environment is classified as a second sound environment.

Item 17. Hearing device according to any of items 1-16, wherein the hearing device is a hearing aid and the processor is configured to compensate for hearing loss of a user.

Item 18. A method of operating a hearing device comprising a processor configured to process a first microphone input signal from a first microphone in a processing set of frequency bands to obtain an electrical output signal, wherein the method comprises detecting a sound impulse in the microphone input signal; and reducing a gain applied to the first microphone input signal in the processor when a sound impulse is detected, wherein detecting a sound impulse comprises applying a detection scheme on the first microphone input signal, wherein the detection scheme defines a detection set of frequency bands, wherein the detection set of frequency bands covers a part of the frequency bands of the processing set, and wherein detecting a sound impulse is based on the detection set of frequency bands.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 first microphone
6 first microphone input signal
8 sound impulse suppression module
10 processor
12 electrical output signal
14 receiver
16 impulse detector
18 sound environment detector
100 method of operating a hearing device
102 detecting a sound impulse in the microphone input signal
104 reducing a gain
106 applying a detection scheme on the first microphone input signal
108 determining rise parameters
110 determining one or more gain reductions
112 transmitting the one or more gain reductions to the processor
114 classifying the sound environment

The invention claimed is:

1. A hearing device comprising:

a first microphone configured to provide of a first microphone input signal;

a sound impulse suppression module configured to detect a sound impulse in the first microphone input signal;

a processor configured to process the first microphone input signal in a first set of frequency bands to obtain an electrical output signal; and a receiver configured to provide an audio output signal based on the electrical output signal, wherein the audio output signal provided by the receiver is based on the processed first microphone input signal in the first set of frequency bands;

wherein the sound impulse suppression module is configured to detect the sound impulse based on a second set of frequency bands, and wherein the frequency bands of the second set for detecting the sound impulse covers a part of the frequency bands of the first set for provisioning the audio output signal.

2. The hearing device according to claim 1, wherein the frequency bands of the second set have lower frequencies above a first frequency threshold.

3. The hearing device according to claim 2, wherein the frequency bands of the second set have upper frequencies below a second frequency threshold.

4. The hearing device according to claim 1, wherein the frequency bands of the second set are within one or more frequency ranges.

5. The hearing device according to claim 1, wherein the first set of frequency bands comprises L frequency bands and the second set of frequency bands comprises M frequency bands, and wherein L−M is greater than or equal to 3.

6. The hearing device according to claim 1, wherein the sound impulse suppression module is configured to determine rise parameters of the first microphone input signal in the frequency bands of the second set, wherein at least one of the rise parameters is indicative of a power increase in the first microphone input signal, and wherein the sound impulse suppression module is configured to detect the sound impulse based on the rise parameters.

7. The hearing device according to claim 6, wherein the sound impulse suppression module is configured to detect the sound impulse based on a number of at least some of the rise parameters reaching respective rise thresholds.

8. The hearing device according to claim 7, wherein the sound impulse is considered to have been detected by the sound impulse suppression module if the number of the at least some of the rise parameters that have reached the respective rise thresholds is larger than a number threshold.

9. The hearing device according to claim 1, wherein the sound impulse suppression module is configured to use a detection scheme to detect the sound impulse, and wherein the detection scheme involves rise thresholds for at least some of the frequency bands of the second set.

10. The hearing device according to claim 9, wherein one of the rise thresholds for one of the at least some of the frequency bands in the second set is different from another one of the rise thresholds for another one of the at least some of the frequency bands in the second set.

11. The hearing device according to claim 6, wherein the rise parameters are based on an instant power estimate and a reference power estimate of the first microphone input signal.

12. The hearing device according to claim 1, further comprising a broadband power estimator, and wherein the sound impulse suppression module is configured to detect the sound impulse based on a broadband power estimate from the broadband power estimator.

13. The hearing device according to claim 1, wherein the sound impulse suppression module is configured to reduce a gain applied to the first microphone input signal by the processor after the sound impulse is detected.

14. The hearing device according to claim 1, further comprising a sound environment detector for classifying a sound environment;

wherein the sound impulse suppression module is configured to apply a first detection scheme if the sound environment is classified as a first sound environment, and wherein the sound impulse suppression module is configured to apply a second detection scheme different from the first detection scheme if the sound environment is classified as a second sound environment.

15. A method performed by a hearing device comprising a processor configured to process a first microphone input signal from a first microphone in a first set of frequency bands to obtain an electrical output signal, and a receiver configured to provide an audio output signal, the method comprising:

detecting a sound impulse in the microphone input signal; and reducing a gain applied to the first microphone input signal in the processor after the sound impulse is detected;

wherein the audio output signal provided from the receiver is based on the first set of frequency bands; and wherein the sound impulse is detected based on a second set of frequency bands, and wherein the frequency bands of the second set for detecting the sound impulse covers a part of the frequency bands of the first set for provisioning the audio output signal.

16. The method according to claim 15, wherein the frequency bands of the second set have lower frequencies above a first frequency threshold.

17. The method according to claim 16, wherein the frequency bands of the second set have upper frequencies below a second frequency threshold.

18. The method according to claim 15, wherein the frequency bands of the second set are within one or more frequency ranges.

19. The method according to claim 15, wherein the first set of frequency bands comprises L frequency bands and the second set of frequency bands comprises M frequency bands, and wherein L−M is greater than or equal to 3.

20. The method according to claim 15, further comprising determining rise parameters of the first microphone input signal in the frequency bands of the second set, wherein at least one of the rise parameters is indicative of a power increase in the first microphone input signal, and wherein the sound impulse is detected based on the rise parameters.

21. The method according to claim 20, wherein the sound impulse is detected based on a number of at least some of the rise parameters reaching respective rise thresholds.

22. The method according to claim 21, wherein the sound impulse is considered to have been detected if the number of the at least some of the rise parameters that have reached the respective rise thresholds is larger than a number threshold.

23. The method according to claim 15, wherein the sound impulse is detected using a detection scheme, and wherein the detection scheme involves rise thresholds for at least some of the frequency bands of the second set.

24. The method according to claim 23, wherein one of the rise thresholds for one of the at least some of the frequency bands in the second set is different from another one of the rise thresholds for another one of the at least some of the frequency bands in the second set.

25. The method according to claim 20, wherein the rise parameters are based on an instant power estimate and a reference power estimate of the first microphone input signal.

26. The method according to claim 15, wherein the sound impulse is detected based on a broadband power estimate from a broadband power estimator.

27. The method according to claim 15, further comprising reducing a gain applied to the first microphone input signal by the processor after the sound impulse is detected.

* * * * *